US009852836B2

(12) United States Patent
Park et al.

(10) Patent No.: US 9,852,836 B2
(45) Date of Patent: Dec. 26, 2017

(54) INDUCTOR AND METHOD FOR MANUFACTURING THE SAME

(71) Applicant: SAMSUNG ELECTRO-MECHANICS CO., LTD., Suwon-si, Gyeonggi-do (KR)

(72) Inventors: Moon Soo Park, Suwon-si (KR); Seong Min Chin, Suwon-si (KR); Hwan Soo Lee, Suwon-si (KR); Hye Yeon Cha, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 108 days.

(21) Appl. No.: 14/054,451

(22) Filed: Oct. 15, 2013

(65) Prior Publication Data

US 2014/0266543 A1 Sep. 18, 2014

(30) Foreign Application Priority Data

Mar. 15, 2013 (KR) ..... 10-2013-0027812

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 17/04*** | (2006.01) |
| ***H01F 41/04*** | (2006.01) |

(52) U.S. Cl.

CPC ..... *H01F 17/0013* (2013.01); *H01F 17/04* (2013.01); *H01F 41/046* (2013.01); *Y10T 29/4902* (2015.01)

(58) Field of Classification Search

CPC ..... H01F 41/046
USPC ..... 336/200, 223, 232
See application file for complete search history.

(56) References Cited

U.S. PATENT DOCUMENTS

| | | | | |
|---|---|---|---|---|
| 6,996,892 | B1 * | 2/2006 | Dening et al. | 29/602.1 |
| 7,719,399 | B2 * | 5/2010 | Iwasaki | H01F 17/0013 336/200 |
| 2005/0068150 | A1 | 3/2005 | Matsutani et al. | |
| 2006/0214759 | A1 * | 9/2006 | Kawarai | H01F 17/0006 336/200 |
| 2007/0030107 | A1 * | 2/2007 | Waffenschmidt | H01F 27/2804 336/200 |

(Continued)

FOREIGN PATENT DOCUMENTS

| | | | |
|---|---|---|---|
| CN | 1685452 | A | 10/2005 |
| CN | 101901668 | A | 12/2010 |

(Continued)

OTHER PUBLICATIONS

English translation of JP2007067214.*

(Continued)

*Primary Examiner* — Ronald Hinson
(74) *Attorney, Agent, or Firm* — McDermott Will & Emery LLP

(57) ABSTRACT

The present invention relates to an inductor. An inductor in accordance with an embodiment of the present invention includes: a core substrate having a conductive pattern on the surface and a magnetic layer for covering the core substrate not to expose the conductive pattern, wherein the magnetic layer is made of a metal-polymer composite and has a multilayer structure.

7 Claims, 4 Drawing Sheets

(56) References Cited

U.S. PATENT DOCUMENTS

| | | | | |
|---|---|---|---|---|
| 2010/0052838 | A1* | 3/2010 | Matsuta | H01F 17/0013 336/200 |
| 2010/0289609 | A1* | 11/2010 | Liao et al. | 336/221 |
| 2013/0033347 | A1 | 2/2013 | Matsuura et al. | |
| 2013/0222101 | A1* | 8/2013 | Ito | H01F 17/04 336/83 |

FOREIGN PATENT DOCUMENTS

| | | | |
|---|---|---|---|
| CN | 102915825 | A | 2/2013 |
| JP | 2005-268455 | A | 9/2005 |
| JP | 2006-210616 | A | 8/2006 |
| JP | 2007-067214 | A | 3/2007 |
| JP | 2008-159654 | A | 7/2008 |
| JP | 2009-044068 | A | 2/2009 |
| JP | 5048155 | B1 | 10/2012 |
| JP | 2013-110171 | A | 6/2013 |
| KR | 10-2006-0102493 | A | 9/2006 |

OTHER PUBLICATIONS

English translation of JP404056113A.*
Office Action Korean Application No. 10-2013-0027812 dated Feb. 4, 2014.
Japanese Office Action issued in Japanese Application No. 2013-208401 dated Mar. 17, 2015.
Chinese Office Action dated Dec. 23, 2015, issued in corresponding Chinese Chinese Patent Application No. 201310728230.5. (w/ English translation).

* cited by examiner

[FIG. 1]
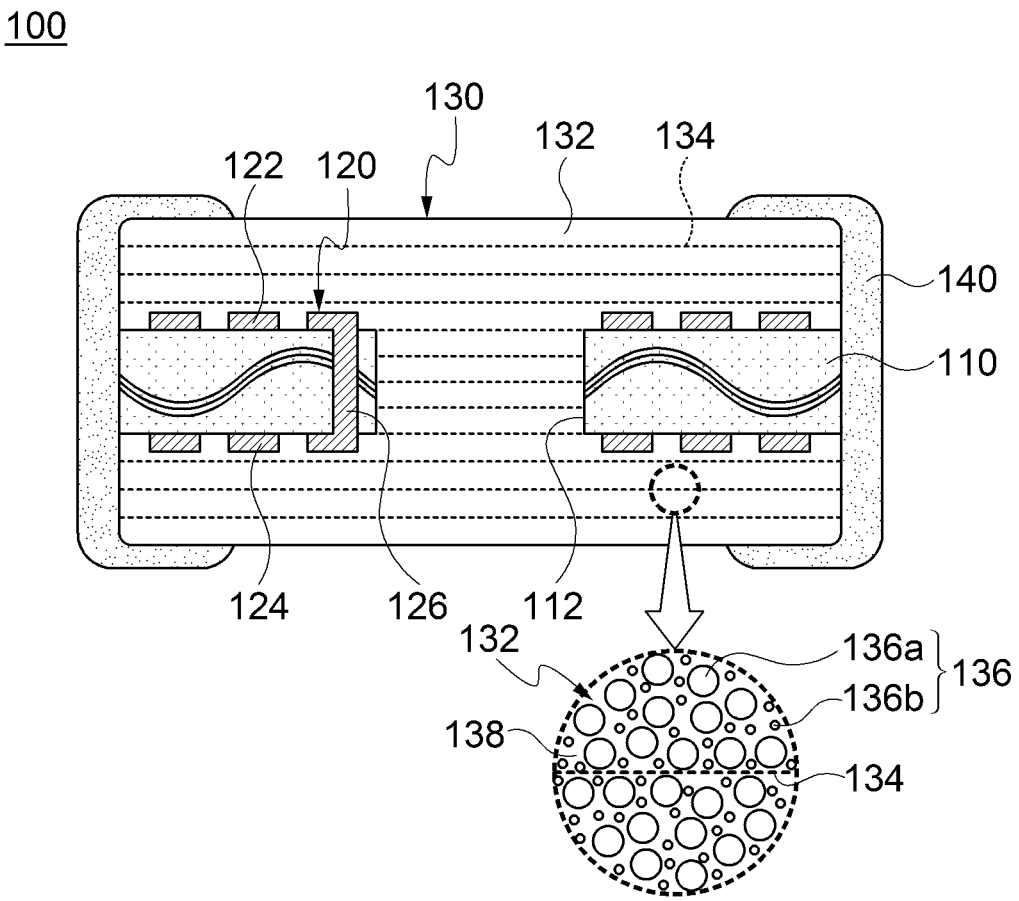

[FIG. 2]
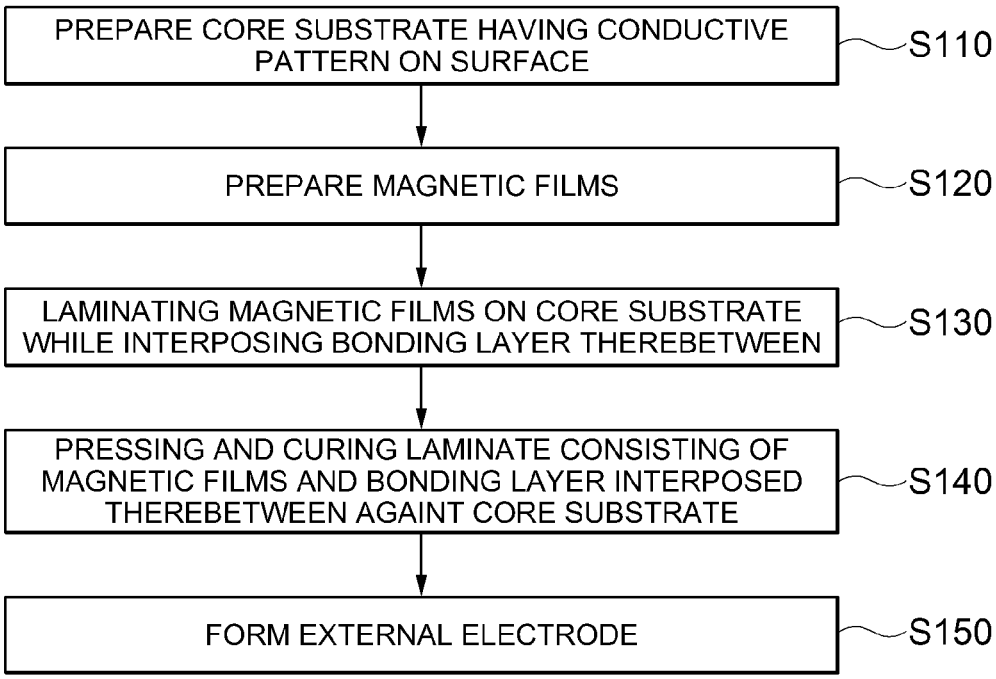
[FIG. 3A]
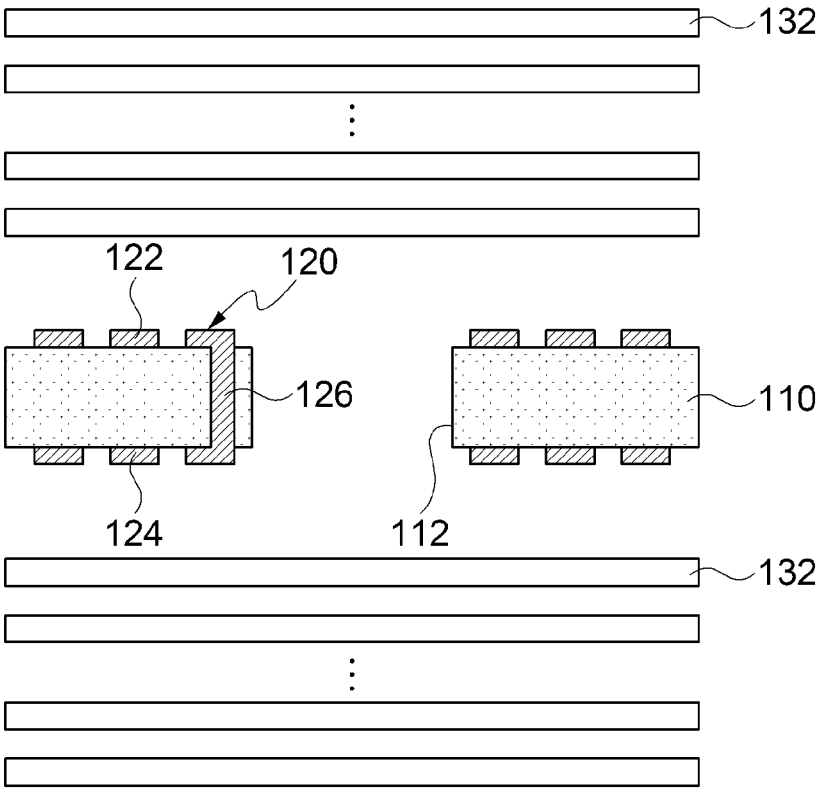

[FIG. 3B]
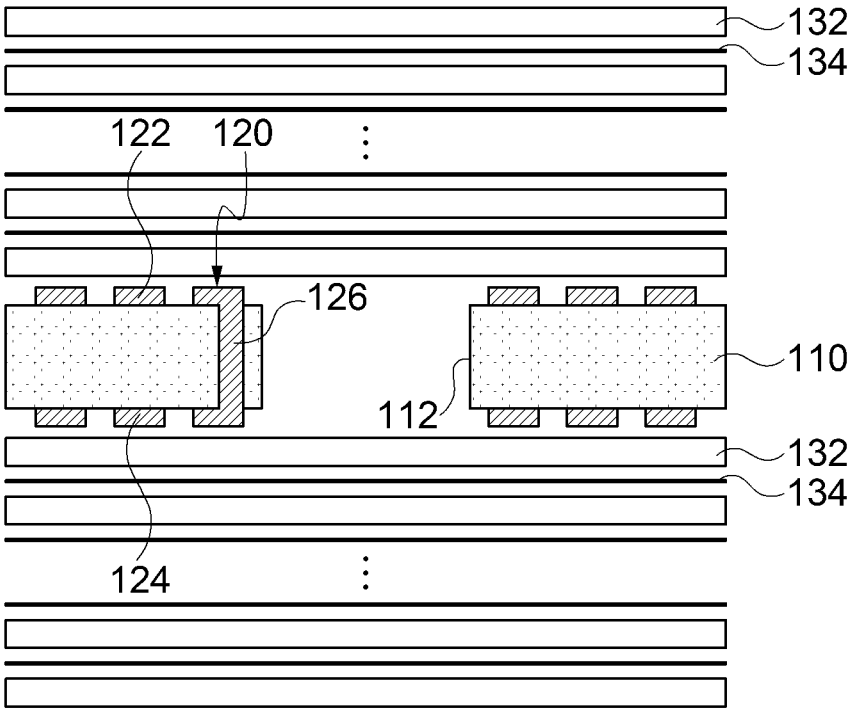
[FIG. 3C]
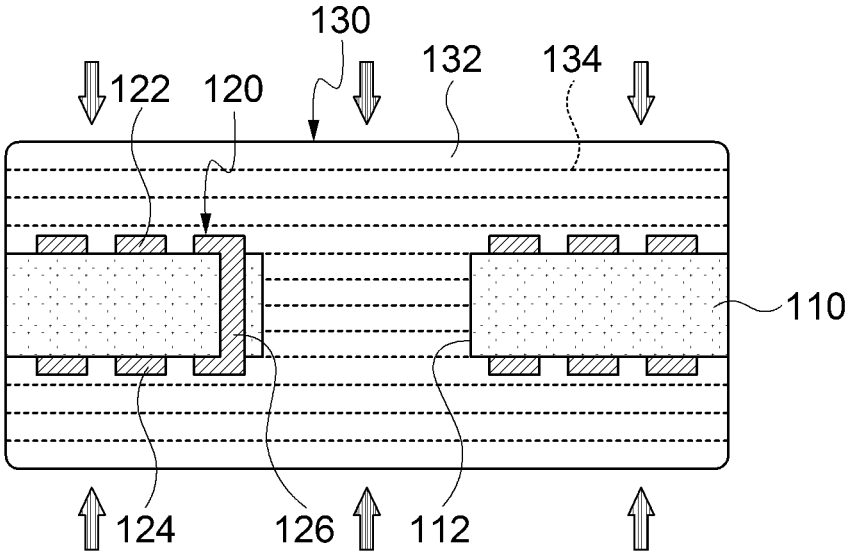

[FIG. 3D]
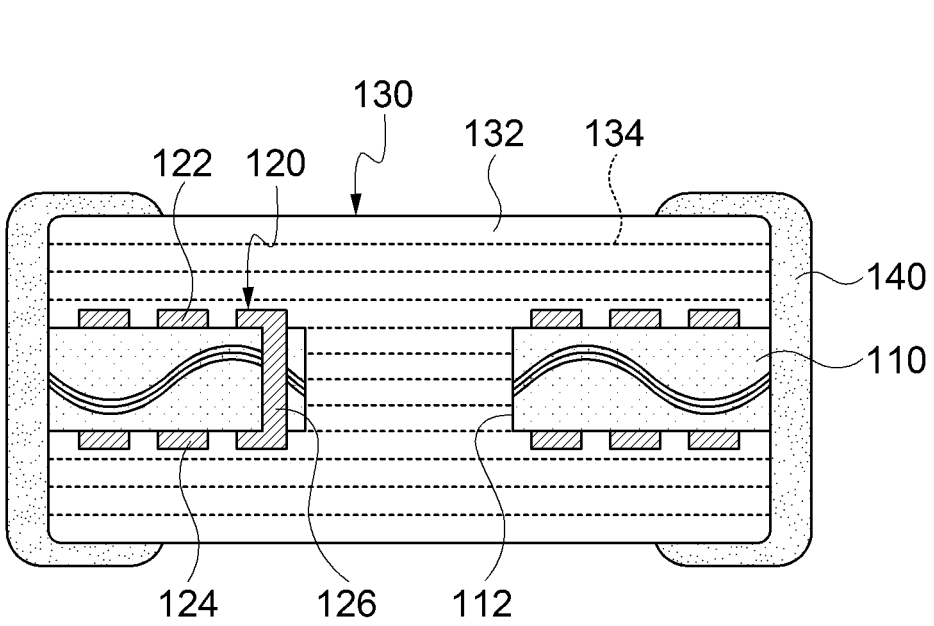

INDUCTOR AND METHOD FOR MANUFACTURING THE SAME

CROSS-REFERENCE TO RELATED APPLICATIONS

Claim and incorporate by reference domestic priority application and foreign priority application as follows:

CROSS REFERENCE TO RELATED APPLICATION

This application claims the benefit under 35 U.S.C. Section 119 of Korean Patent Application Serial No. 10-2013-0027812, entitled filed Mar. 15, 2013, which is hereby incorporated by reference in its entirety into this application.

BACKGROUND OF THE INVENTION

1. Field of the Invention

The present invention relates to an inductor and a method for manufacturing the same, and more particularly, to an inductor with improved inductance characteristics and a method for manufacturing the same.

2. Description of the Related Art

In general, a thin film power inductor is manufactured by covering a core substrate having a coil thereon with a predetermined magnetic material. More specifically, a typical thin film power inductor is manufactured by preparing a metal-polymer composite consisting of magnetic powder and resins and a substrate having a winding thereon and a through hole in the center thereof and filling the metal-polymer composite in the through hole to cover both surfaces of the substrate.

However, the above method for manufacturing an inductor needs separate equipment such as a mold and a jig and thus causes an increase in manufacturing costs. Further, when using the metal-polymer composite, since there are limitations in increasing the content of the metal magnetic powder to secure processability of the metal-polymer composite, there are limitations in manufacturing an inductor with a high inductance value. Further, the metal-polymer composite is pressed and heated on the substrate in a semi-cured state to cover the substrate, but in this case, the metal-polymer resin composite is not completely filled in the through hole.

RELATED ART DOCUMENT

Patent Document

Patent Document 1: Japanese Patent Laid-open No. 2008-159654

SUMMARY OF THE INVENTION

The present invention has been invented in order to overcome the above-described problems and it is, therefore, an object of the present invention to provide an inductor with improved inductance characteristics and a method for manufacturing the same.

It is another object of the present invention to provide an inductor having a structure that can increase the content of metal magnetic powder of a magnetic layer constituting a device body of an inductor and a method for manufacturing the same.

It is still another object of the present invention to provide a method for manufacturing an inductor that can improve a filling ratio of a metal-resin composite.

In accordance with one aspect of the present invention to achieve the object, there is provided an inductor including: a core substrate having a conductive pattern on the surface thereof and a magnetic layer for covering the core substrate not to expose the conductive pattern, wherein the magnetic layer is made of a metal-polymer composite and has a multilayer structure.

In accordance with an embodiment of the present invention, the magnetic layer may include a plurality of magnetic films and a bonding layer interposed between the magnetic films.

In accordance with an embodiment of the present invention, the bonding layer may be made of the same material as a thermosetting resin used in the metal-polymer composite.

In accordance with an embodiment of the present invention, the bonding layer may be made of an epoxy resin.

In accordance with an embodiment of the present invention, the magnetic layer may be formed by pressing the plurality of magnetic films, which are made of the metal-polymer composite, against the core substrate.

In accordance with an embodiment of the present invention, the core substrate may have a through hole in the region in which the conductive pattern is not formed, and the magnetic layer may have a filling portion filled in the through hole and a covering portion for covering the conductive patterns on both surfaces of the substrate.

In accordance with an embodiment of the present invention, the metal-polymer composite may include an amorphous epoxy resin and metal magnetic powder included in the amorphous epoxy resin in an amount of 75 to 98 wt % based on the metal-polymer composite.

In accordance with an embodiment of the present invention, the metal-polymer composite may include at least two metal particles having different average particle sizes.

In accordance with another aspect of the present invention to achieve the object, there is provided a method for manufacturing an inductor, including the steps of: preparing a core substrate having a conductive pattern on the surface thereof; manufacturing magnetic films made of a metal-polymer composite; laminating the magnetic films on the core substrate; and forming a magnetic layer having a multilayer structure by pressing the magnetic films against the core substrate.

In accordance with an embodiment of the present invention, the step of laminating the magnetic films may include the step of interposing a film type bonding layer between the magnetic films.

In accordance with an embodiment of the present invention, the step of laminating the magnetic films may include the step of coating a bonding material on opposite surfaces of the magnetic films.

In accordance with an embodiment of the present invention, the step of laminating the magnetic films may include the step of interposing a bonding layer made of an epoxy resin material between the magnetic films.

In accordance with an embodiment of the present invention, the step of forming the magnetic layer may be performed in the process conditions of 170 to 200° C., surface pressure of 0.05 to 20 Kgf, and vacuum of less than 0.1 torr.

In accordance with an embodiment of the present invention, the method for manufacturing an inductor may further include the step of forming a through hole in the core substrate, and the step of forming the magnetic layer may include the step of filling the through hole.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a view showing an inductor in accordance with an embodiment of the present invention;

FIG. 2 is a flowchart showing a method for manufacturing an inductor in accordance with an embodiment of the present invention; and FIGS. 3*a* to 3*d* are views for explaining a process of manufacturing an inductor in accordance with an embodiment of the present invention.

DETAILED DESCRIPTION OF THE PREFERABLE EMBODIMENTS

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Further, embodiments to be described throughout the specification will be described with reference to cross-sectional views and/or plan views, which are ideal exemplary drawings of the present invention. In the drawings, the thicknesses of layers and regions may be exaggerated for the effective explanation of technical contents. Therefore, the exemplary drawings may be modified by manufacturing techniques and/or tolerances. Therefore, the embodiments of the present invention are not limited to the accompanying drawings, and can include modifications to be generated according to manufacturing processes. For example, an etched region shown at a right angle may be formed in the rounded shape or formed to have a predetermined curvature.

Hereinafter, an inductor and a method for manufacturing the same in accordance with an embodiment of the present invention will be described in detail with reference to the accompanying drawings.

FIG. 1 is a view showing an inductor in accordance with an embodiment of the present invention. Referring to FIG. 1, an inductor 100 in accordance with an embodiment of the present invention, which is a multilayer power inductor, may include a core substrate 110, a conductive pattern 120, a magnetic layer 130, and an external electrode 140.

The core substrate 110 may be a base for manufacture of the inductor 100. At least one through hole 112 may be formed in the core substrate 110 to pass through the core substrate 110. The through hole 112 may be provided substantially in the center region of the core substrate 110, where the conductive pattern 120 is not formed. The through hole 112 may be provided to increase the occupied area of the magnetic layer 130 in the inductor 100 and filled with predetermined magnetic powder.

The conductive pattern 120 may be formed on both surfaces of the core substrate 110. As an example, the conductive pattern 120 may include a first pattern 122 formed on one surface of the core substrate 110, a second pattern 124 formed on the other surface opposite to the one surface of the core substrate 110, and a connector 126 passing through the core substrate 110 to electrically connect the first and second patterns 122 and 124. The conductive pattern 120 having this structure may form at least one coil on the core substrate 110. The conductive pattern 120 may be made of various metal materials. As an example, the conductive pattern 120 may be made of silver (Ag) or copper (Cu).

The magnetic layer 130 may cover the both surfaces of the core substrate 110 while filling the through hole 112. The magnetic layer 130 may consist of a filling portion which fills the through hole 112 and a covering portion which covers the both surfaces of the core substrate 110. The magnetic layer 130 having this structure may constitute a device body of the inductor 100 having a substantially hexahedral shape.

The external electrode 140 may cover both external ends of the device body while being electrically connected to the conductive pattern 120. The external electrode 140 may be used as an external connection terminal for electrically connecting the inductor 100 to an external electronic device (not shown).

Meanwhile, the magnetic layer 130 may be made of a metal-polymer composite material. For example, the metal-polymer composite may be a metal-polymer composite consisting of metal magnetic powder 136 and an uncured thermosetting resin 138. The metal magnetic powder 136 may be various metal powders having magnetism. The thermosetting resin 138 may be an amorphous epoxy resin. The amorphous epoxy resin may be easily manufactured into a film compared to crystalline epoxy such as biphenyl type epoxy. Particularly, when a novolac epoxy resin or a rubber polymer epoxy resin having a molecular weight of greater than 15000 is used, it may be very easily manufactured into a film. In addition, the thermosetting resin may be polyimide or liquid crystal polymer (LCP). The thermosetting resin as above may be included in an amount of about 2.0 to 5.0 wt % based on the weight of the metal magnetic powder.

The content of the metal magnetic powder 136 may be about 75 to 98 wt % based on the metal-polymer composite. When the content of the metal magnetic powder 136 is less than about 75 wt % based on the metal-polymer composite, since the content of the thermosetting resin 138, which is a non-magnetic material, is relatively increased, the magnetic layer 130 may act as a factor that interrupts the flow of a magnetic flux for implementing the characteristics of the inductor 100. Commonly, when only the content of the metal magnetic powder 136 is less than about 75 wt % based on the metal-polymer composite in a state in which other conditions are the same, it is checked that an inductance value of the inductor is reduced by about 30% compared to a design value. On the other hand, when the content of the metal magnetic powder 136 exceeds 98 wt % based on the composite, the yield of the magnetic film 132 may be remarkably reduced since the properties of the metal-polymer composite becomes difficult to manufacture the magnetic film 132 for manufacturing the magnetic layer 130.

It may be preferred that the metal magnetic powder 136 consists of metal particles having different particle sizes. When the particle sizes of the metal magnetic powder 136 are all the same, it may be difficult to secure dispersability of the magnetic powder in the magnetic layer 130 due to a difficulty in securing high dispersability of the metal magnetic powder in the metal-polymer composite. In order to prevent this, it may be preferred that the metal magnetic powder 136 is a mixture of a first metal particle 136*a* having an average diameter of about 20 μm to 100 μm and a second metal particle 136*b* having an average diameter of less than about 10 μm.

Further, the magnetic layer 130 may have a multilayer structure. For example, the magnetic layer 130 may include a plurality of magnetic films 132 laminated on the substrate 110 and a bonding layer 134 interposed between the magnetic films 132. The magnetic films 132 may be thin film type sheets made of the metal-polymer composite material. The bonding layer 134 may give adhesion between the magnetic films 132. The bonding layer 134 may be made of various types of resin materials. For example, the bonding layer 134 may be made of the same resin material as that used in the metal-polymer composite constituting the magnetic layer 130. As an example, the epoxy resin may be an amorphous epoxy resin. In this case, the bonding layer 134 may prevent deterioration of functions of the magnetic layer 130 as well as give the adhesion between the magnetic films 132.

The higher the filling ratio of the metal magnetic powder in the magnetic layer 130, the higher the inductance characteristics of the inductor 100. This means that the minimization of the relative content of the resin in the metal-polymer composite is advantageous in terms of the inductance characteristics. However, if the content of the resin is extremely reduced, since the adhesion between the magnetic films 132 is not secured, the content of the resin should be secured to at least about 5 wt % based on the metal-polymer composite. However, the inductor 100 in accordance with an embodiment of the present invention can maximize the content of the metal magnetic material in the metal-polymer composite, which is a material of the magnetic films 132, and can secure the adhesion between the magnetic films 132 by providing the separate bonding layer 134 between the magnetic films 132. Therefore, in the inductor 100, the magnetic layer 130 can have a multilayer structure consisting of the magnetic films 132 and the bonding layer 134 for bonding them, and due to the bonding layer 134 as above, it is possible to prevent lifting between the magnetic films 132 and maximize the content of the metal magnetic powder with respect to the magnetic films 132.

As described above, the inductor 100 in accordance with an embodiment of the present invention includes the core substrate 110 having the conductive pattern 120 on the surface, the magnetic layer 130 which covers the core substrate 110, and the external electrodes 140 which cover the both external ends of the magnetic layer 130, wherein the magnetic layer 130 may have a multilayer structure consisting of the magnetic films 132 and the bonding layer 134 interposed between the magnetic films 132 to bond the magnetic films 132. In this case, the bonding layer 134 can reinforce the deterioration of the adhesion between the magnetic films 132 caused by increasing the content of the metal magnetic powder of the magnetic films 132 to about 98 wt % based on the metal-polymer composite. Accordingly, the inductor in accordance with the present invention can remarkably increase the inductance value of the inductor by remarkably increasing the content of the metal magnetic powder of the magnetic layer which covers the core substrate having the conductive pattern on the surface. Further, the inductor in accordance with the present invention can prevent the lifting due to the insufficient adhesion between the magnetic films by forming the magnetic layer, which covers the core substrate to have a multilayer structure consisting of the plurality of magnetic films and the bonding layer and bonding the magnetic films through the bonding layer.

Continuously, a method for manufacturing an inductor in accordance with an embodiment of the present invention will be described in detail. Here, descriptions overlapping with those of the above-described inductor 100 may be omitted or simplified.

FIG. 2 is a flowchart showing a method for manufacturing an inductor in accordance with an embodiment of the present invention, and FIGS. 3*a* to 3*d* are views for explaining a process of manufacturing an inductor in accordance with an embodiment of the present invention.

Referring to FIGS. 2 and 3*a*, a core substrate 110 having a conductive pattern 120 on the surface may be prepared (S110). The core substrate 110 may be a circuit board having the conductive patterns 120 formed on both surfaces to form a coil and a through hole 112 formed in the region in which the conductive pattern 120 is not formed. The conductive pattern 120 may consist of a first pattern 122, a second pattern 124, and a connector 126 for connecting the first and second patterns 122 and 124. The core substrate 110 may be prepared by forming the conductive pattern 120 on a predetermined insulation plate and performing a punching process on the core substrate 110 to form the through hole 112.

Magnetic films 132 may be prepared (S120). The step of preparing the magnetic films 132 may be performed by manufacturing a metal-polymer composite and casting the metal-polymer composite to manufacture the metal-polymer composite into a sheet. Here, it is possible to further improve processability by increasing a mechanical strength of the magnetic films 132. For this, a rubber toughening agent may be further added to the metal-polymer composite. It may be preferred that the content of the rubber toughening agent is adjusted to about 1 to 30 part per hundred resin (PHR) of the amorphous epoxy resin. When the content of the rubber toughening agent is less than about 1 PHR, since the content thereof is too low, it may not be effective in improving the mechanical strength of the magnetic films 132. On the other hand, when the content thereof exceeds 30 PHR, degradation of mechanical properties may occur after a curing process of the magnetic films 132.

Referring to FIGS. 2 and 3*b*, the magnetic films 132 may be laminated on the core substrate 110 with a bonding layer 134 interposed therebetween (S130). More specifically, the above-described magnetic films 132 may be sequentially laminated on both surfaces of the core substrate 110. At this time, the bonding layer 134 may be interposed between the magnetic films 132. As an example, the bonding layer 134 may be formed by coating a predetermined bonding material on the respective magnetic films 132 through spray coating. As another example, the bonding layer 134 may be manufactured into a film and positioned between the magnetic films 132. The bonding layer 134 may be made of the same material as the polymer resin used in the metal-polymer composite.

Referring to FIGS. 2 and 3*c*, a magnetic layer 130 may be formed by pressing and curing a laminate consisting of the magnetic films 132 and the bonding layer 134 on the core substrate 110. The process of pressing and curing the laminate may be adjusted to satisfy predetermined temperature, surface pressure, and vacuum conditions. More specifically, the curing temperature may be adjusted to about 170 to 200° C. When the curing temperature is less than 170° C., the laminate may not be completely cured, and when the curing temperature exceeds 200° C., the resin of the magnetic films 132 may be deteriorated. The surface pressure may be adjusted to about 0.05 to 20 kgf. When the surface pressure is less than 0.05 kgf, since the pressure on the laminate is low, the magnetic films 132 may not be completely filled in the through hole 112 having a depth of about hundreds of μm. When the surface pressure exceeds 20 kgf, the core substrate 110 may be deformed due to excessive pressing. And the degree of vacuum may be a condition required for removing a residual solvent in the magnetic films 132 when forming the magnetic layer 130. For this, the degree of vacuum may be adjusted to less than 1 torr.

Accordingly, the magnetic layer 130, which has a multilayer structure consisting of the magnetic films 132 and the bonding layer 134 interposed therebetween while covering the both surfaces of the core substrate 110, can be formed. Since the magnetic layer 130 can be effectively filled in the through hole 112 of the core substrate 110 and the content of the metal magnetic powder in the magnetic films 132 is high, a filling ratio of the metal magnetic powder in the filling portion of the magnetic layer 130 filled in the through hole 112 can be also increased.

And external electrodes 140 may be formed on both ends of the surface of the device body having the magnetic layer 130 (S140). The step of forming the external electrodes 140 may be performed by forming metal electrodes on the both external ends of the device body of the inductor formed by the magnetic layer 130. Here, before forming the external electrodes 140, a dicing process of cutting the core substrate 110 having the magnetic layer 130 thereon into a plurality of portions may be performed.

As described above, the method for manufacturing an inductor in accordance with an embodiment of the present invention can form the magnetic layer 130 which covers the core substrate 110 by pressing the laminate consisting of the magnetic films 132 and the bonding layer 134 interposed therebetween against the both surfaces of the core substrate 110. In this case, it is possible to prevent the deterioration of the adhesion between the magnetic films 132 while increasing the content of the metal magnetic powder 136 of the magnetic films 132. Accordingly, the method for manufacturing an inductor in accordance with the present invention can provide an inductor with an improved inductance value by increasing a filling ratio of metal magnetic powder of a magnetic layer constituting a device body of the inductor. Further, the method for manufacturing an inductor in accordance with the present invention can manufacture an inductor that can prevent lifting due to insufficient adhesion between magnetic films by forming a magnetic layer, which constitutes a device body, to have a multilayer structure consisting of a plurality of magnetic films and a bonding layer.

The inductor in accordance with the present invention can remarkably improve an inductance value of an inductor by remarkably increasing a filling ratio of metal magnetic powder of a magnetic layer which covers a core substrate.

The inductor in accordance with the present invention can prevent lifting due to insufficient adhesion between magnetic films by forming a magnetic layer, which covers a core substrate, to have a multilayer structure consisting of a plurality of magnetic films and a bonding layer.

The method for manufacturing an inductor in accordance with the present invention can provide an inductor with a remarkably improved inductance value by remarkably increasing a filling ratio of metal magnetic powder of a magnetic layer which covers a core substrate.

The method for manufacturing an inductor in accordance with the present invention can provide an inductor that can prevent lifting due to insufficient adhesion between magnetic films by forming a magnetic layer, which constitutes a device body, to have a multilayer structure consisting of a plurality of magnetic films and a bonding layer.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An inductor comprising:

a core substrate having a conductive pattern on the surface thereof and a through hole;

and a magnetic layer covering a region of the core substrate not exposed to the conductive pattern and filling the through hole, wherein the magnetic layer has a multilayer structure and comprises, both above the core substrate and below the core substrate, a plurality of magnetic films each made of a metal-polymer composite and a plurality of bonding layers respectively interposed between the magnetic films; wherein the through hole is filled with the plurality of magnetic films and the plurality of bonding layers of the multilayer structure.

2. The inductor according to claim 1, wherein the plurality of bonding layers are made of the same material as a thermosetting resin used in the metal-polymer composite.

3. The inductor according to claim 1, wherein the plurality of bonding layers are made of an epoxy resin.

4. The inductor according to claim 1, wherein the magnetic layer is formed by pressing the plurality of magnetic films, which are made of the metal-polymer composite, against the core substrate.

5. The inductor according to claim 1, wherein the core substrate has the through hole formed in the region in which the conductive pattern is not formed, and the magnetic layer has a filling portion filled in the through hole and a covering portion for covering the conductive pattern.

6. The inductor according to claim 1, wherein the metal-polymer composite comprises:

an amorphous epoxy resin; and metal magnetic powder included in the amorphous epoxy resin in an amount of 75 to 98 wt % based on the metal-polymer composite.

7. The inductor according to claim 1, wherein the metal-polymer composite comprises at least two metal particles having different average particle sizes.

* * * * *